US005311998A

United States Patent [19]

Lerner et al.

[11] Patent Number: 5,311,998

[45] Date of Patent: May 17, 1994

[54] METHOD OF GRADING ITEMS AND AN APPARATUS MATERIALIZING SAME

[76] Inventors: Moisei M. Lerner, 56/5 Trumpeldor, Petah-Tikva; Svyatoslav M. Voldman, 49/15, Kadish Luzst, Kiryat-Mozkin, Haifa, both of Israel; Moisei F. Milgrom, bulvar Larisa, 16, kv. 13; Petr L. Buryan, ulitsa Karla Marxa 8, kv. 12, both of Moldova, Belts, Russian Federation; Khaskel A. Tarandash, 32/14 Einstein street, Lod, Israel; Alexei I. Suschenko, ulitsa Volodarskogo, 27b, kv. 24, Moldova, Belts, Russian Federation

[21] Appl. No.: 910,173

[22] PCT Filed: Nov. 14, 1990

[86] PCT No.: PCT/SU90/00242

§ 371 Date: Jul. 14, 1992

§ 102(e) Date: Jul. 14, 1992

[87] PCT Pub. No.: WO92/08553

PCT Pub. Date: May 29, 1992

[51] Int. Cl.[5] ..... B07C 5/00

[52] U.S. Cl. ..... 209/552; 209/586; 209/698; 209/701; 198/365

[58] Field of Search ..... 209/580, 581, 582, 586, 209/698, 701, 538, 552, 556, 558; 198/365

[56] References Cited

U.S. PATENT DOCUMENTS

| | | | |
|---|---|---|---|
| 1,432,762 | 10/1922 | Ladd | 209/580 X |
| 2,908,375 | 10/1959 | Hoover et al. | 209/698 X |
| 3,275,135 | 9/1966 | Niese | 209/698 X |
| 3,741,371 | 6/1973 | Oldershaw et al. | 209/701 X |
| 3,773,172 | 11/1973 | McClure et al. | 209/73 |
| 4,241,835 | 12/1980 | Lockett | 209/582 |
| 4,317,521 | 3/1982 | Clark et al. | 209/558 |
| 4,324,335 | 4/1982 | Conway et al. | 209/586 |
| 4,351,437 | 9/1982 | Long | 209/586 X |
| 4,549,272 | 10/1985 | Hagan et al. | 364/478 |
| 4,586,613 | 5/1986 | Horii | 209/556 |
| 4,726,898 | 2/1988 | Mills et al. | 209/701 X |
| 4,846,335 | 7/1989 | Hartlepp | 209/698 X |
| 4,993,535 | 2/1991 | Scata | 209/698 X |

FOREIGN PATENT DOCUMENTS

| | | |
|---|---|---|
| 555764 | 10/1986 | Australia . |
| 2530501 | 1/1984 | France . |
| 62-279875 | 12/1987 | Japan . |

*Primary Examiner*—D. Glenn Dayoan
*Assistant Examiner*—Dean A. Reichard
*Attorney, Agent, or Firm*—Ladas & Parry

[57] ABSTRACT

A method and apparatus for grading items such as roots and tubers in which a succession of items are conveyed one after the other in a U-shaped channel of a conveyor. As each item passes a measuring station a grading characteristic of the item is measured and compared with a predetermined value. The items are transferred from the conveyor to addressing stations based on the compared grading characteristics of the items. The grading characteristics of each item is measured by measuring the orthogonal projection of each item onto the conveyor, and the conveyor is formed by successive transverse conveyor elements, each item having an orthogonal projection extending over at least three adjacent conveyor elements. The items are transferred from the conveyor by displacing the at least three conveyor elements either to lift the item off the conveyor or to allow the items to drop below the conveyor. The conveyor can be a linear conveyor or a loop conveyor.

18 Claims, 11 Drawing Sheets

METHOD OF GRADING ITEMS AND AN APPARATUS MATERIALIZING SAME

FIELD OF THE INVENTION

The present invention relates generally to sorting of items, and in a more particular sense has reference to grading of agricultural projects after harvesting and pre-market treatment.

The basic criterion of the grading quality is the accuracy of addressing the item depending on the preset values of the grading characteristics.

DESCRIPTION OF THE PRIOR ART

Known in the art are methods of grading agricultural products in the process of after-harvesting and pre-market treatment, and apparatus for realization of the methods. In this apparatus the items are fed to a monitoring zone by a piece-by-piece feeding unit to determine a current value of grading characteristics and compare it with a preset value. In doing so, the monitoring can be effected in the process of free falling of the items or directly at the feeding unit.

When the items are monitored in the course of their free falling, restrictions as to the number of fractions when grading is done by one device are possible. These restrictions take place due to a wide spread of the pathways within the location area of actuators, which are arranged along the pathway of the item. This necessitates increase in the dimensions of the actuators and causes more damage to the items being graded due to enhanced velocity of their motion (U.S. Pat. No. 4,241,835).

In case the items are monitored at the feeding unit, it is necessary to impart a definite space attitude to the products within the monitoring zone and in the course of their conveyance to the actuator. For this purpose the feeding unit is provided with cells for accommodation of the products being graded, the addressing of the products being carried out by the action of the actuators onto the cell. Hence, only one item is received by the cell, and variations in the size of the products being graded can correspondingly affect the throughput capacity when grading various items (U.S. Pat. No. 4,735,823).

Known in the art is a method of grading items fed in a flow into a monitoring zone and a device for materializing same in which the monitoring of items and subsequent addressing of each item is effected by a plurality of actuators, each having its analizing unit. (V. I. Starovoitov, A. M. Bashilov, A. L. Andershanov "Automation of monitoring quality of potatoes, vegetables and fruit", VO "Agropromizdat" Publishers, Moskow, 1987, pp. 135–139). This allows elimination of cell-shaped structure of feeding unit.

Known in the art is a method of grading items carrying out piece-by-piece single-row feeding of items into the monitoring zone and successive conveyance to the places of addressing. In this method the removal of items by the monitoring signal is done with the aid of pivotable members incorporated into the zone of the travel across the pathway of the items. The accuracy of addressing in this particular case depends on the correspondence of the values of distances between the items, the speed of their conveyance and the time of interaction of the actuators and the items (U.S. Pat. No. 4,549,272).

Known in the art is a method of grading items transferred by a conveyor having supporting members, the method providing piece-by-piece feeding in at last one row of the items into the monitoring zone, their direction to the places of addressing, measuring of a current value of grading characteristics, comparing it with a preset value, followed by distribution of the items among the places of addressing according to the results of the comparison.

In this apparatus addressing of the items is done without taking into account their type and dimensions. Known in the art is an apparatus for the embodiment of this method of grading items, comprising a feeding unit, a conveyor with supporting members, a means for directing the items to the places of addressing, a monitoring system provided with a unit for measuring a preset value of the grading characteristic linked with the actuator. Each supporting member comprises a definite number of pivotable slats which facilitate smooth disposal of the items to the place of addressing; however, the grading is effected without the account for the items' type and dimension whereby the throughput capacity of the device is affected due to incomplete utilization of loading coefficient of the feeding unit (FR, B, 2,530,501).

SUMMARY OF THE INVENTION

It is an object of the invention to provide a method of distributing items among the places of addressing in the course of their grading, taking into account the type and dimensions of the item and quality grade characteristics, and an apparatus for embodying the method.

The object is attained in the proposed method for the distribution of items, preferably, root and tuber crops, among the places of their addressing in the process of their grading. The items are transferred by a conveyor incorporating supporting members thereby effecting piece-by-piece feeding in at least one row, of the items into a monitoring zone, directing the items to the places of addressing, measuring a current value of a grading characteristic, comparing it with a preset value and subsequent distribution of the items among the places of addressing according to the results of the comparison. According to the invention, a necessary minimum number of supporting members of the conveyor portion is determined, required for the possibility of withdrawing the item upon retracting of the supporting members of this conveyor portion at the place of addressing which is specified by the results of comparison of the preset value and the measured current value of the grading characteristic. This provides independent withdrawal of the items to the place of addressing irrespective of the conveyor loading coefficient.

It is advisable that the necessary minimum number of the supporting members of the conveyor portion is determined according to the number of members onto which an orthogonal projection falls of the item being handled, the number being no less than three. This ensures correspondence of the arrangement of the supporting members on the conveyor to the size of the item being handled.

The proposed method is embodied in an apparatus for grading items, comprising a unit for single-layer piece-by-piece feeding of items, a conveyor incorporating supporting members, a means for directing the items to the places of addressing and automatic control system provided with a device for measuring current values of the grading characteristics and actuators, wherein, according to the invention, each supporting member is mounted on the conveyor with a possibility of independent pivoting round the axis parallel to the direction of the conveyor travel, whereas the automatic control system is additionally provided with a unit defining a number of supporting members onto which an orthogonal projection falls of the item being handled and a unit for monitoring the motion of the supporting members linked therewith, the device for measuring the values of the grading characteristics being interconnected with the unit defining the number of supporting members.

Advantageously, each supporting member in the apparatus according to the invention comprises a supporting portion and a tail piece pivotably mounted on the conveyor through a bracket, and the actuator is essentially an electromagnet whose core functions as a retainer adapted for maintaining the tail piece of the supporting member in the initial position. This embodiment facilitates retraction of the supporting member at the place of addressing under the action of the electromagnetic field, which renders the apparatus less power consuming with respect to mechanical friction.

It is expedient that each pivotable member of the conveyor be mounted in such a manner that its surface is arranged in a horizontal plane. This ensures the transfer of the items to the places of addressing which are fixed in position in the horizontal plane.

Preferably, the apparatus according to the invention incorporates at least one additional conveyor having supporting members and arranged parallel to the main conveyor, the supporting members being mounted with an inclination, facing each other so as to define a U-shaped channel for placing of the items therein, and at least one conveyor is provided with similarly formed members located on the opposite sides with respect to the longitudinal axis of the conveyor. This ensures oriented position of the item with respect to the device for measuring current values of the grading characteristics.

It is expedient to provide each supporting portion of the supporting members with a sleeve mounted with a possibility of free rotation around the axis, whereas the sleeves of at least two adjacent supporting members are oppositely threaded. This structural feature enables a differential control of the item being handled to be carried out due to the rotation imparted thereto by the sleeves without changing its position with respect to the conveyor in the direction of the conveyor travel.

Advantageously, each retainer comprises a housing accommodating spring-loaded latches mounted therein along the longitudinal axis thereof, linked with locking strips and offset relative to one another in the direction of the conveyor travel, whereby the position of the supporting members is controlled simultaneously in two adjacent channels.

Preferably, in the apparatus according to the invention use is made of a horizontal loop rotory conveyor provided with a restrictor concentrically arranged therein, adapted for rotating in synchronism with the conveyor and defining with the pivotable members of the conveyor, a U-shaped channel for accommodating the items therein. This allows utilization of the apparatus in the technological flow lines with radial withdrawal of the items being graded.

It is expedient that the restrictor be mounted with a possibility of free rotation thereby simplifying the drive of the apparatus.

It is preferable that the horizontal loop rotory conveyor be provided with a piece of metal section to ensure equidistant fixing of the supporting members to the conveyer around the perimeter thereof.

This facilitates the manufacture process of the apparatus with the oriented fixing of the pivotable members of the conveyor.

Thus, the effect manifesting itself in the addressing of the items being handled irrespective of the spacing between the items is attributed to the utilization of the conveyors featuring such an arrangement of the supporting members which is specified from the condition of minimum type and dimension of the items, each of which being projected onto no less than 3 supporting members in the monitoring zone.

BRIEF DESCRIPTION OF THE DRAWINGS

Given below is a detailed description of the embodiments of the invention, not limiting the scope thereof, with reference to the accompanying drawing, wherein.

DETAILED DESCRIPTION OF A PREFERRED EMBODIMENT OF THE INVENTION

In the description which follows the same members will be referred to the same reference numbers.

Figure 1:
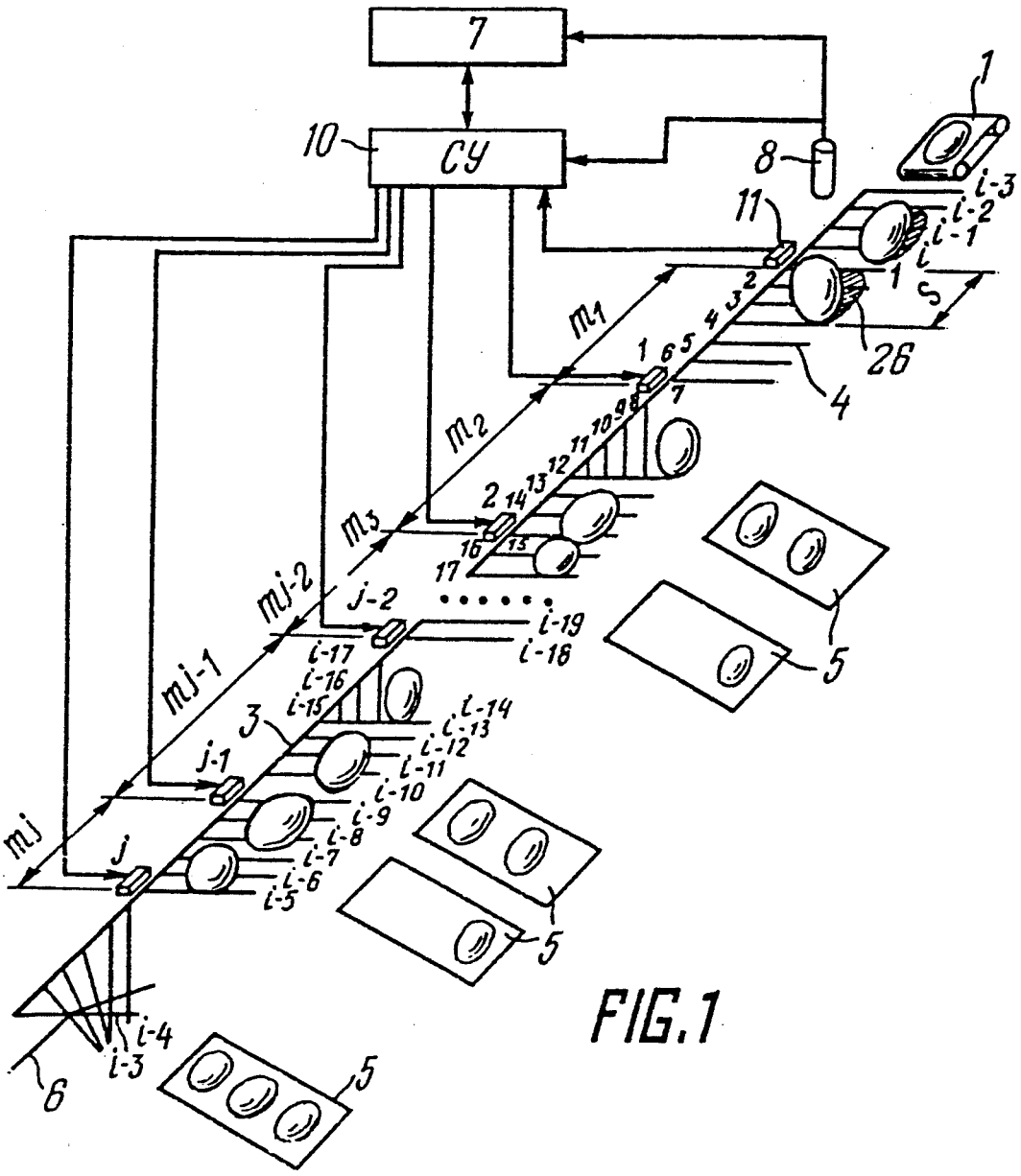
FIG. 1 is schematic view of an apparatus for grading items, according to the invention.

FIG. 1 presents the installation for the realization of the method according to the invention.

The apparatus for grading items (FIG. 1) comprises a unit 1 for single-layer piece-by-piece feeding of items 2, a conveyor 3 with supporting members 4, a means 5 for directing the items to the places of addressing, a means 6 for returning the supporting members to the initial position, an automatic control system 7 incorporating a device 8 for measuring current values of the grading characteristics connected to actuators 9, a unit 10 for defining a number of supporting members onto which an orthogonal projection falls of the item being handled, and a unit 11 for monitoring the motion of the supporting members interconnected therewith.

Figure 2:
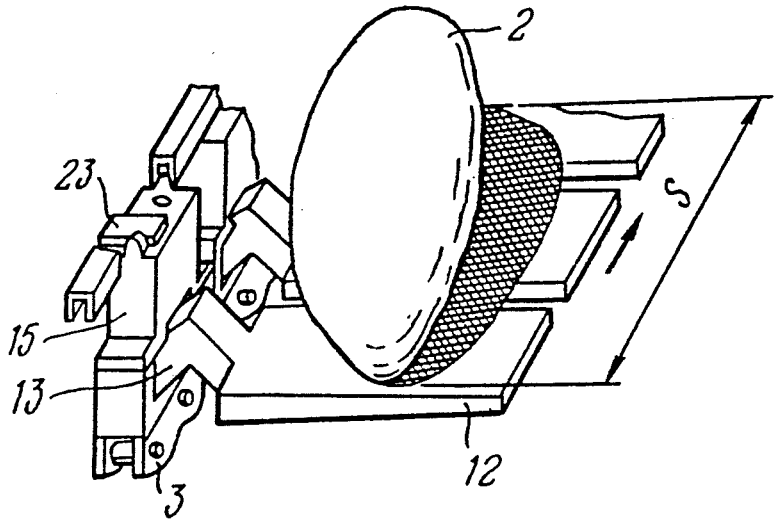
FIG. 2 is a portion of a longitudinal conveyor with supporting members, according to the invention.
Figure 3:
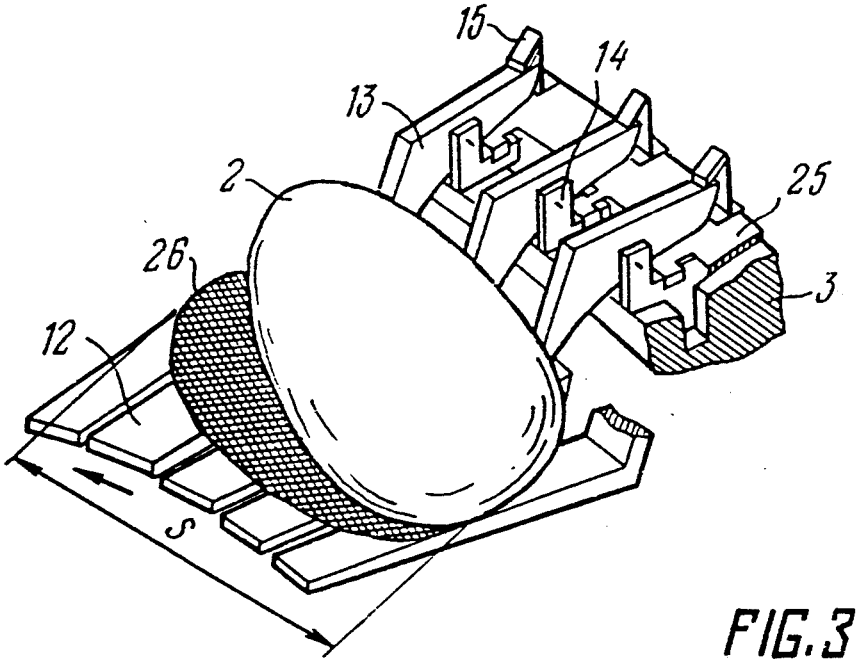
FIG. 3 is a portion of the conveyor with supporting members for a horizontal loop rotory conveyor.

The conveyor portion onto which an orthogonal projection falls of the item being handled includes at least two supporting members pivotally mounted on the conveyor and defining a portion 26 of the conveyor surface (FIGS. 1, 2, 3).

Figure 4:
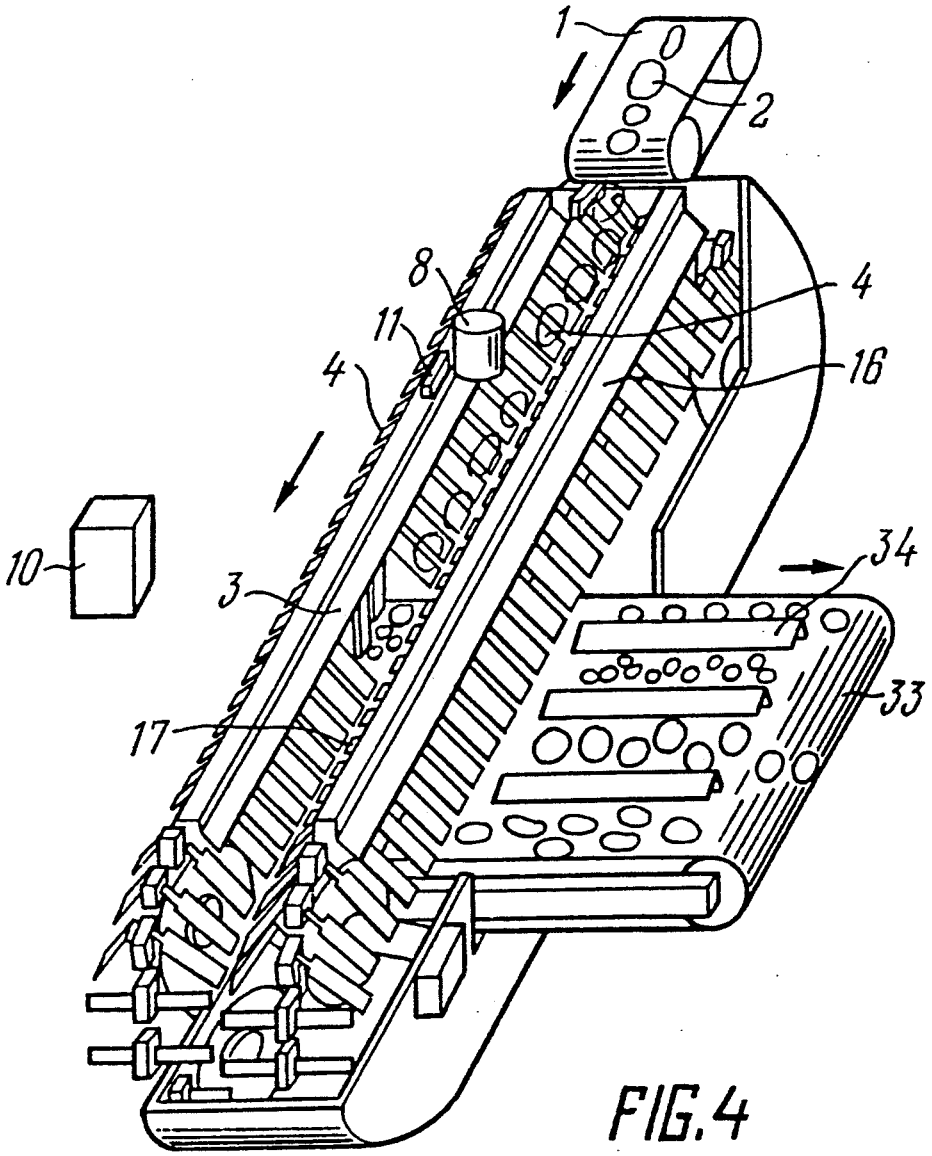
FIG. 4 is an embodiment of the apparatus with inclined supporting members defined a U-shaped channel.
Figure 5:
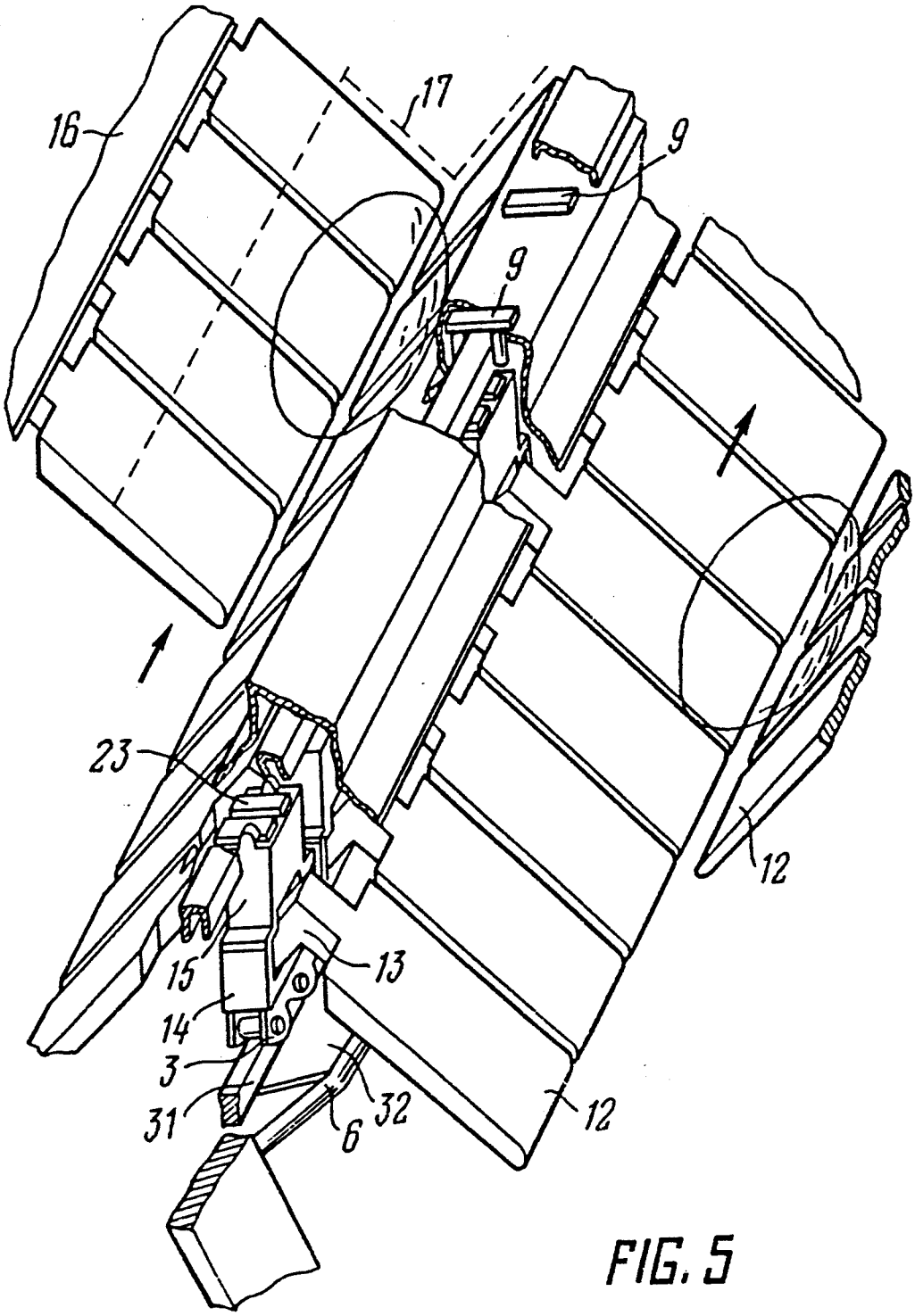
FIG. 5 shows a portion of the conveyor with inclined supporting members defining a U-shaped channel.
Figure 8:
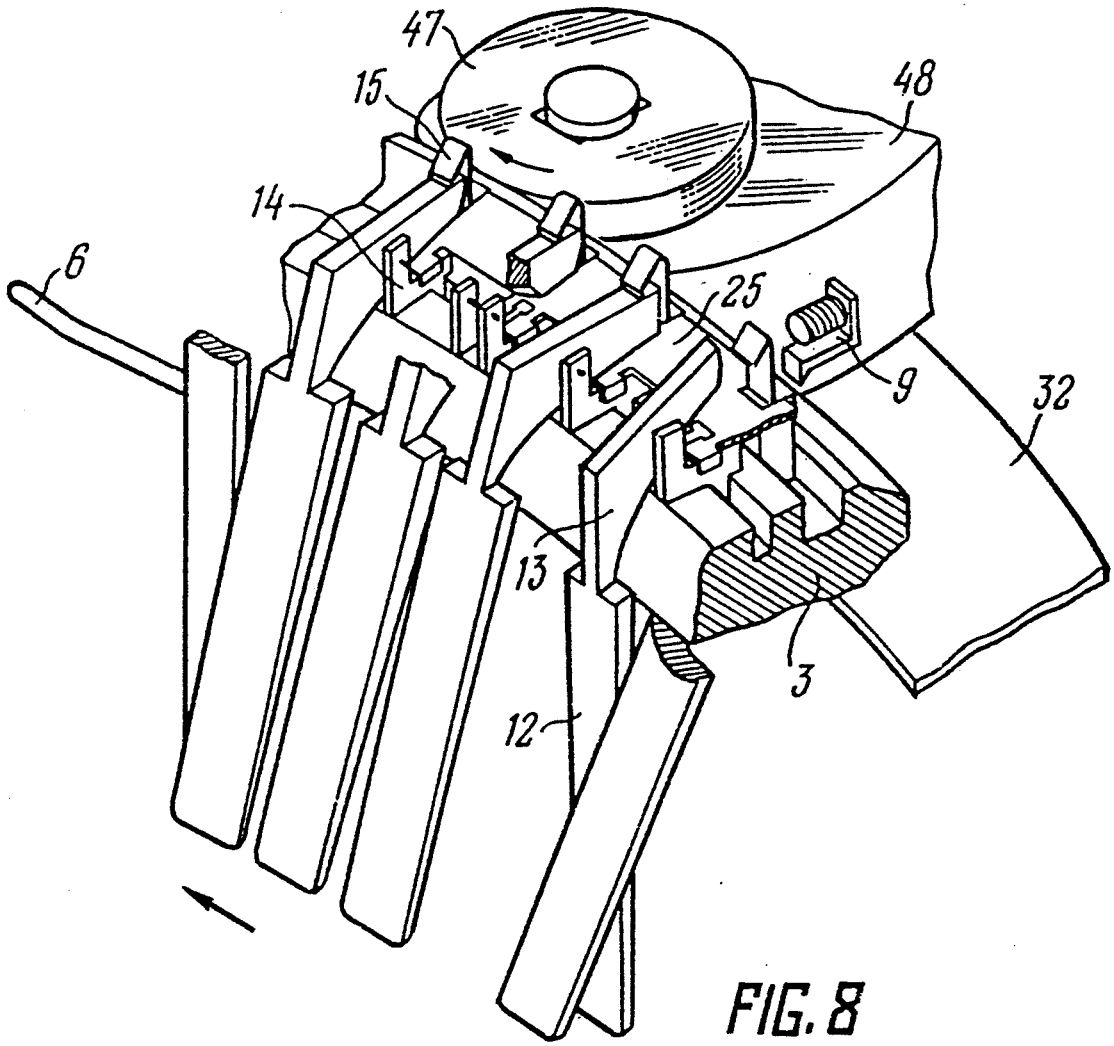
FIG. 8 shows a portion of the rotory conveyor with inclined pivotable members.

Each supporting member comprises a supporting portion 12 and a tail piece 13 pivotally mounted on the conveyor through brackets 14, the conveyor being provided with a retainer 15 mounted with a possibility of interaction with the tail piece 13 of the supporting member (FIGS. 5, 8). Moreover, the apparatus is equipped with at least one additional conveyor 16 (FIGS. 4, 5) with supporting members installed parallel to the main conveyor, the supporting members being arranged inclined to one another so as to define a U-shaped channel 17 for accommodating the items therein, and at least one conveyor is provided with similarly shaped supporting members positioned on the opposite sides with respect to the longitudinal axis of the conveyor.

Figure 9:
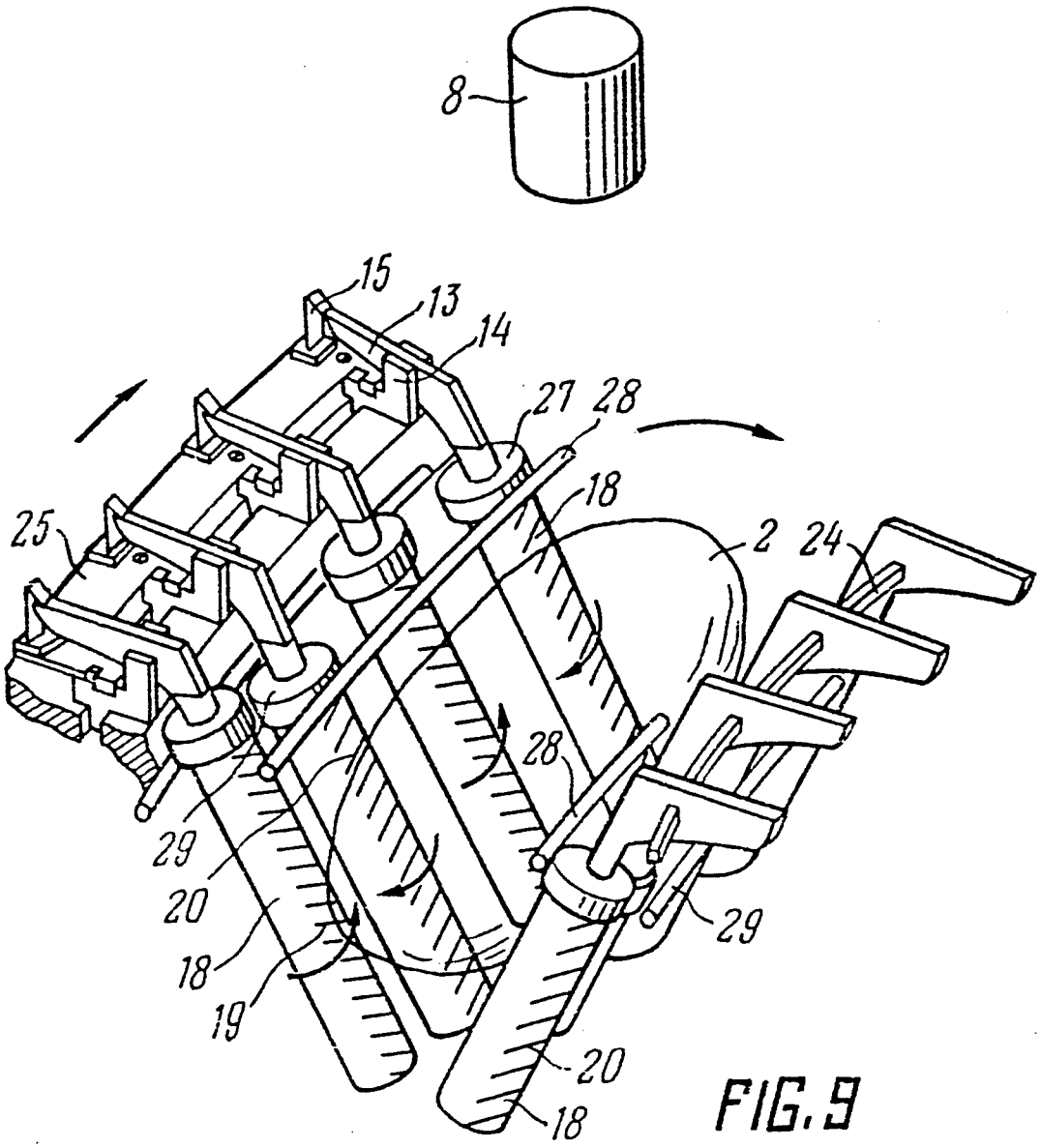
FIG. 9 shows a portion of the rotory conveyor for differential examination of the items being handled.

To ensure differential control of the size of the item being handled (FIG. 9), the supporting portions of the supporting members are shaped as sleeves 18 mounted lengthwise along the longitudinal axis, and at least two sleeves have oppositely directed threaded elements 19, 20 adapted for rotating in opposite directions.

Each sleeve is provided with a roll 27 in the upper portion beyond the zone of accommodation of the item being handled, the rolls of the oppositely threaded sleeves being offset as regards height with respect to the longitudinal axis of the supporting portion of the pivotable members so as to ensure interaction with respective master forms 28, 29, mounted in the monitoring zone on different sides of the sleeves in the direction of their motion.

Figure 10:
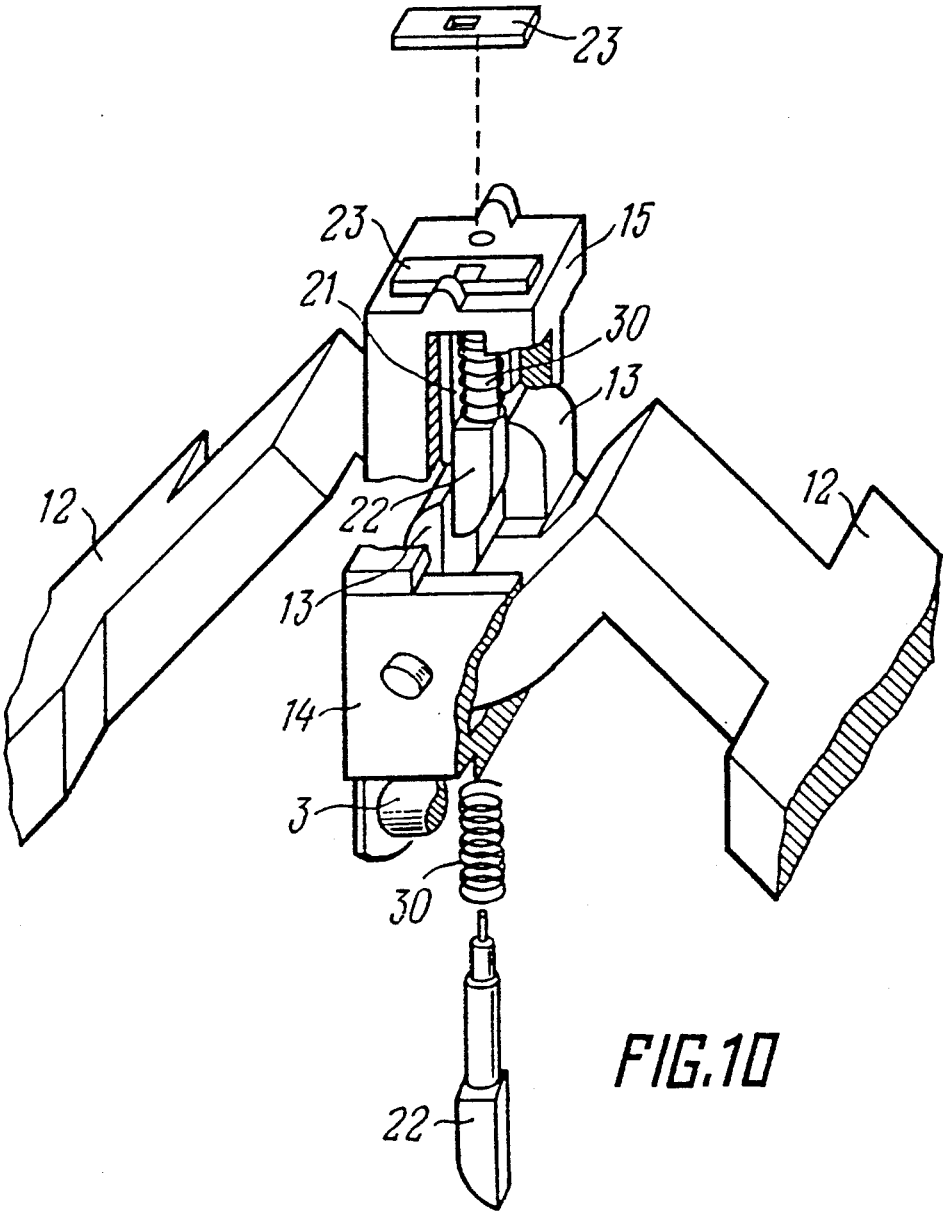
FIG. 10 shows a structural arrangement of a retainer in accordance with FIG. 5.
Figure 11:
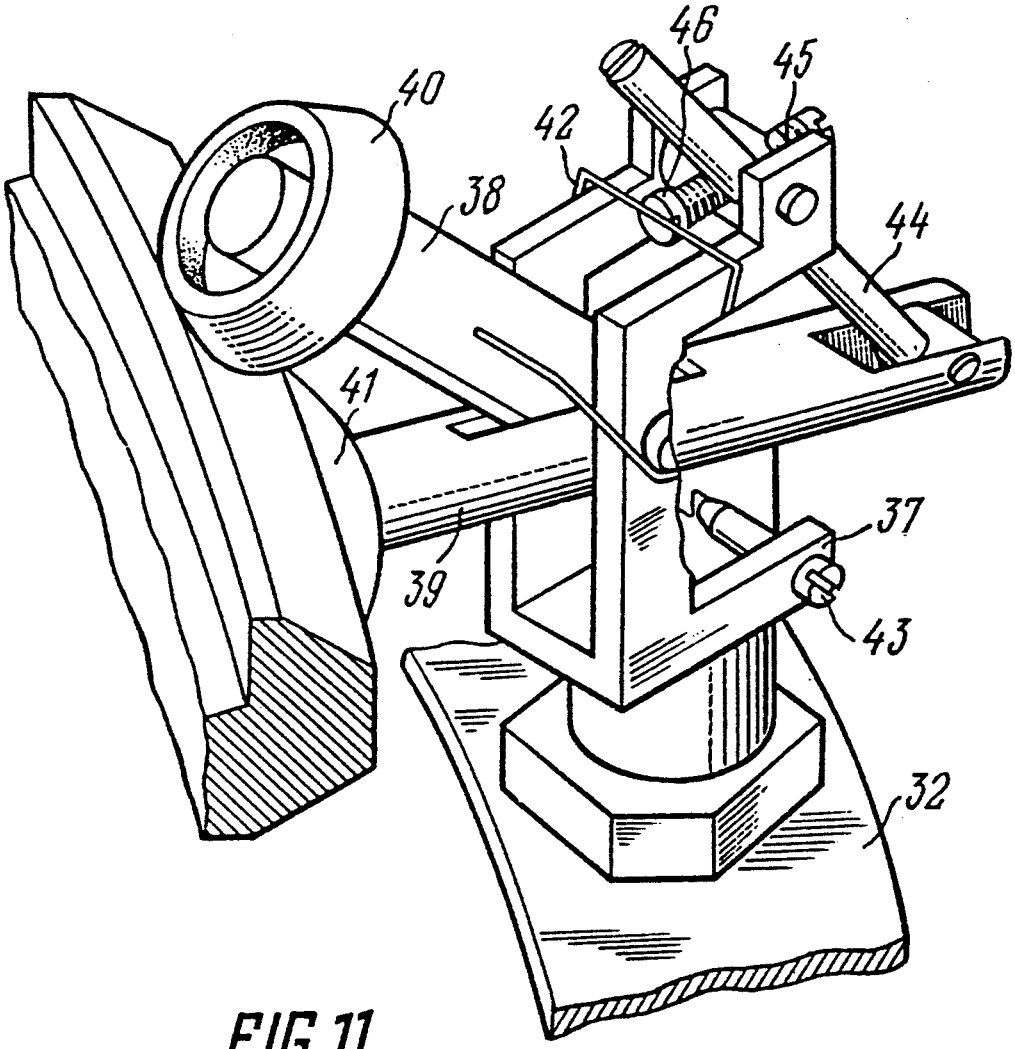
FIG. 11 shows an embodiment of a floating support of the rotory conveyor.

Each retainer 15 (FIG. 10) comprises a guiding surface 21 provided with latches 22 mounted therein along the longitudinal axis thereof and spring-loaded by springs 30, the latches being linked to locking strips 23 and offset with respect to one another in the direction of the conveyor travel. This structural arrangement of the retainer is necessary in the case of the additional conveyor 16.

In the case of utilization of a horizontal loop rotary conveyor 3 (FIGS. 6, 7), the conveyor is provided with a restrictor 24 arranged concentrically inside the conveyor and adapted for rotting in synchronism therewith, and defining with the supporting members a U-shaped channel for accommodating the items therein.

The rotory conveyor 3 is provided with a metal section 25 (FIGS. 3, 8, 9) facilitating equidistant fixing of the pivotable members in the conveyor plane around the perimeter thereof.

The longitudinal conveyor 3 is essentially a roller chain whose rolls rest upon a guide 31 of a supporting plate 32 which also carries a master form 6 (FIG. 5). The means 5 for directing the items to the addressing places (FIG. 4) is essentially a conveyor 33 provided with separating partitions 34 serving to separate flows of the items after their addressing.

Figure 6:
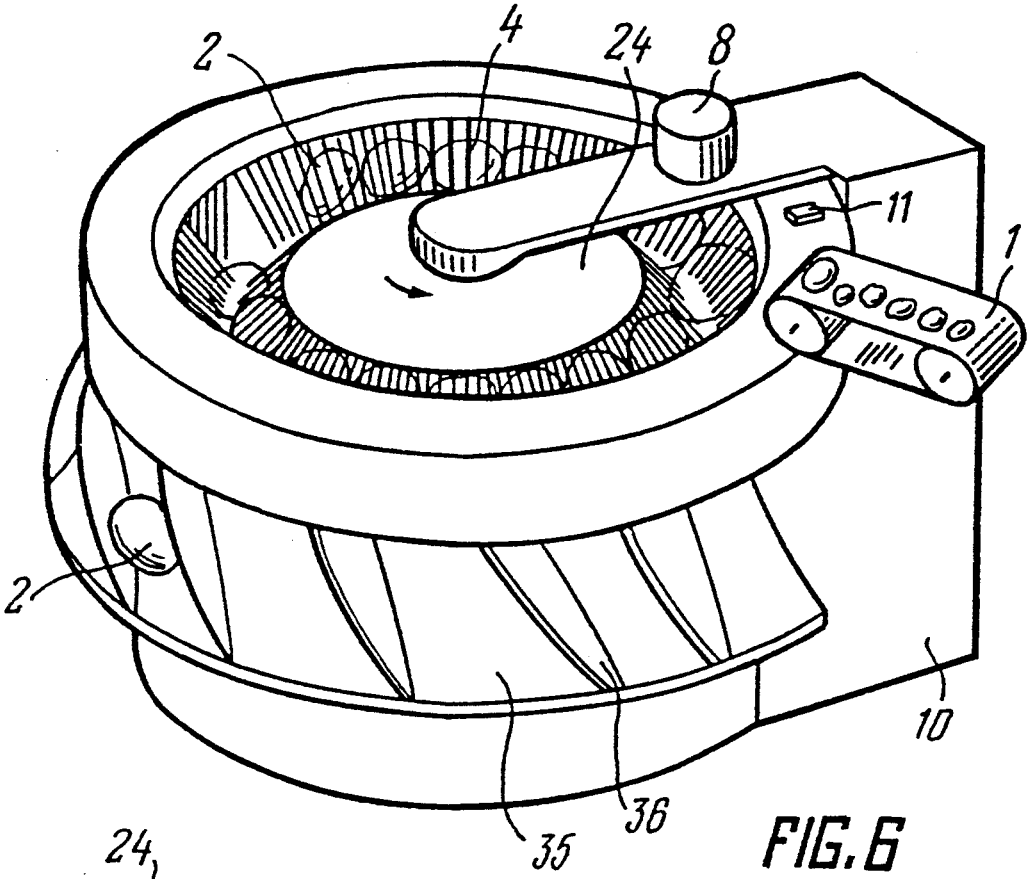
FIG. 6 shows an embodiment of the apparatus with a horizontal loop rotory conveyor.
Figure 7:
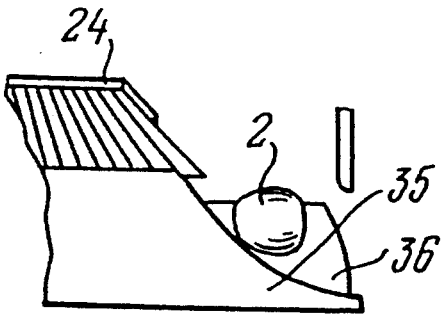
FIG. 7 shows a portion for withdrawing items from the rotory conveyor.

In the case of the horizontal loop rotary conveyor, the device for directing the items to the addressing places is essentially a surface 35 shaped as a paraboloid which is necessary for damping the velocity of the item when withdrawing the item to the place of addressing (FIGS. 6, 7). The separating partitions 36 in this particular case are necessary for damping the horizontal speed component of the item.

For alignment of the surface of the rotary conveyor 3 with respect to the restrictor 24 concentrically arranged therein, provided around the periphery of the conveyor on the outer side thereof with a possibility of being vertically adjusted are floating supports fixed to the supporting plate 32. The floating support is essentially a fork 37 secured to the supporting plate 32, hingedly positioned wherein are brackets 38, 39 with taper rollers 40, 41 mounted on the ends thereof with a possibility of rotation and simultaneous interaction with the side surface of the conveyor 3, the positioning of the bracket 38 being adjusted by a spring 42 and a screw 43, whereas the positioning of the bracket 39 is adjusted by a screw 44. The force of the spring 42 is varied by an adjusting screw 45 and a splined washer 46.

To put the rotory conveyor in motion provision is made for a friction roller 47 set on the shaft of a geared electric motor 48.

DESCRIPTION OF THE METHOD

In the process of grading, the items being handled (preferably root and tuber crops) are fed piece-by-piece in at least one row to the monitoring zone by a quantified load-carrying surface. In the monitoring zone each item is examined by a control unit to specify the grading characteristics. The characteristics determining the criteria according to which the items are separated also point to their place of addressing. For instance, to effect grading using, as grading characteristics, the color of the item incorporated into the monitoring zone is an optical control system which determines spectral characteristics of the item. The current value obtained is compared with a preset value of boundaries of the spectral characteristics. The result of the comparison in this particular case gives information on the place of addressing.

Moreover, in the monitoring zone the size of the item being handled on the supporting members of the conveyor is evaluated so as to determine the minimum number of supporting members of the conveyor portion required for withdrawing the item when this conveyor portion is removed at the place of addressing which is specified by the results of the comparison.

The conveyor portion can be determined as a number of the conveyor supporting members onto which an orthogonal projection falls of the item being handled. Next, the conveyor supporting members transfer the item after the examination to the place of addressing, where only those of the supporting members interact with the actuator which define the conveyor portion. Thus, the item is withdrawn to the place of addressing by virtue of removal of the supporting members.

In the course of travel of the item being handled from the monitoring zone to the place of addressing, the position of the item with respect to the supporting members carrying the item should be strictly defined within the portion preset in the monitoring zone.

This facilitates independent and successive withdrawal of the items at their places of addressing.

The apparatus embodying the method of grading items operates as follows.

Items 2, preferably root and tuber crops, to be transferred for grading according to grading characteristics are fed piece-by-piece by the feeding unit 1 of the items 2 to the conveyor 3 provided with supporting members 4, wherein the items, assigned a stable position, travel to the monitoring zone. The device 8 for measuring current values of grading characteristics of automatic control system 7 determines the current values of the grading characteristics; the intrinsic features and those features the user is interested in are detected and converted into electric signals.

Figure 12:
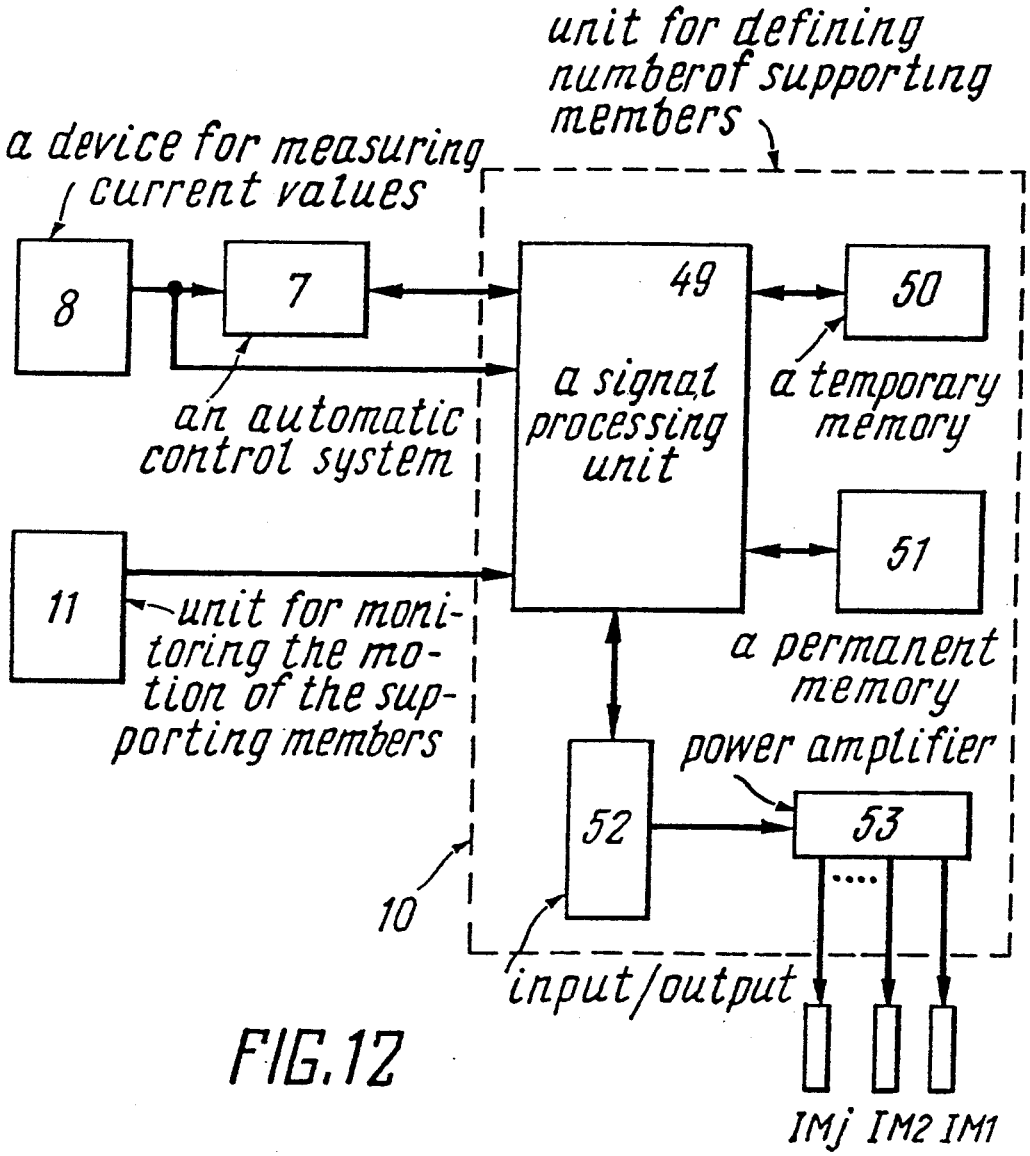
FIG. 12 is a block diagram of the apparatus.
Figure 13:
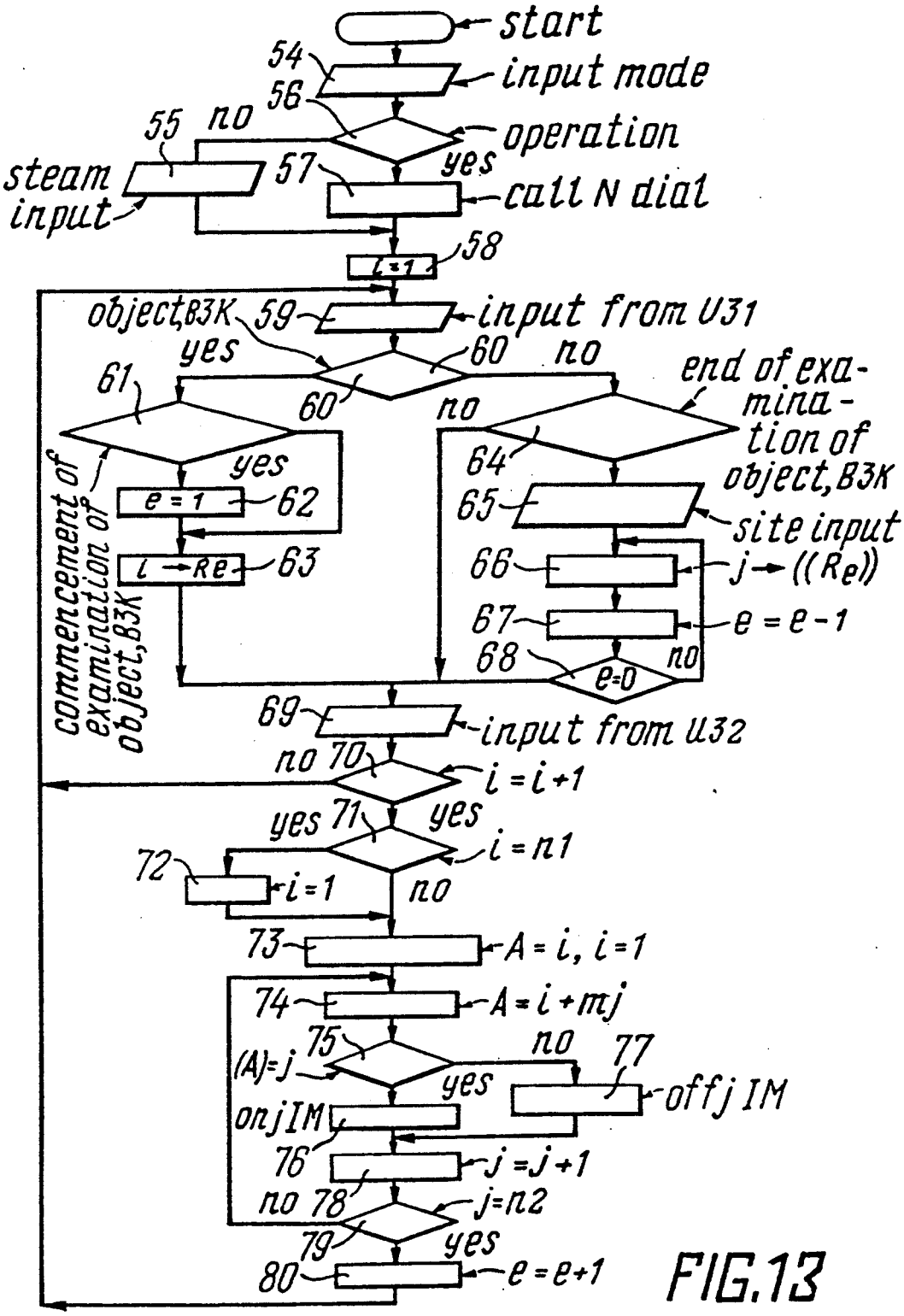
FIG. 13 illustrates the algorithm of the apparatus operation.

A block-diagram of the apparatus and algorithm of the operation is illustrated in FIGS. 12, 13.

The unit 10 for determining the number of supporting members comprises a signal processing unit 49, a temporary memory 50, a permanent memory 51, an input/output 52, and a power amplifier 53.

The apparatus is operated by switching on operating modes. If the apparatus is not in the mode of "operation", the signal processing unit 49 is transferred to the input mode parameters (unit 55).

Through the agency of the input/output 52 the user sets the algorithm of treatment of the item parameters he is interested in, which are obtained in the device 8 for measuring current values of grading characteristics, sets the measure of grading the items being handled, coordinates of the places of addressing, their mutual arrangement and number. The input data of the user can be stored in accordance with his wish in the permanent memory 51 with assignment of a definite number to the set of input data. Further on, the user can call forth any required set by putting in the assigned member.

If the "Operating Mode" is put in (unit 56), the user calls forth the necessary set (unit 57) by the input/output 52.

Then the signal processing unit 49 starts the processing of the information on the items 2 being handled. First the signal processing unit assigns a number to the supporting member 4 located in the monitoring zone number i=I (unit 58), then the input of the information is effected from the unit 8 for measuring current values of grading parameters to the signal processing unit 49 (unit 59). The signal processing unit 49 detects the presence of signals from the unit 8 for measuring current values of grading parameters (unit 60). The presence or absence of the signal indicates the location of the item 2 in the monitoring zone above the supporting member. When the item enters the monitoring zone the signal processing unit 49 indicates this moment (unit 61) and puts into operation a counter of supporting members 1=I (unit 62) onto which the item is being handled. The number of the member located in the monitoring zone (unit 63) is entered into the register of the numbers of the members onto which an orthogonal projection falls of the item being handled.

Under the conditions of current signal processing when the item is in the monitoring zone the unit 62 is inoperative.

When there is no item in the monitoring zone the signal processing unit 49 registers the moment the item leaves the monitoring zone (unit 64).

The unit 10 for determining the number of supporting members puts in the information from the automatic control unit 7 of the place of addressing of the handled item (unit 65).

The place of addressing was specified by the results of the information obtained in the unit 8 for measuring current values of the grading characteristics.

The number of the place of addressing is put into the signal processing unit 49 which sends it to the memory cells of the temporary memory with the addresses which are defined by the register $R_1$ of the numbers of the supporting members onto which an orthogonal projection falls of the item (units 66, 67, 68).

Thus, the temporary memory device 50 keeps the record of the place of addressing, and the number of supporting members on which an orthogonal projection falls of the item being handled.

Further on, the signal processing unit 49 puts in information from the unit 11 for determining the motion of the supporting members (unit 69).

When the next supporting member appears in the monitoring zone, it is assigned the next number (unit 70).

If the next supporting member does not appear in the monitoring zone, the signal processing unit 49 returns to the input of the information from the unit 8 of measuring current values of grading characteristics.

When the next supporting member enters the monitoring zone and receives the corresponding number, the signal processing unit 49 checks the correspondence of this number to the total amount of the supporting members on the conveyor (unit 71).

If the number of this supporting member exceeds the total amount of the supporting members on the conveyor, this member receives number i=I (unit 72).

Then the signal processing unit 49 reads the memory cells which determine the position of the actuators at the definite time period.

Using the distances $m_j$ which actually show the amount of supporting members between the monitoring zone and the actuators 9 the addresses of the memory cells of the temporary memory device 50 (unit 73, 74) are determined.

If the data of the memory cells of the temporary memory device coincides with the number J of the actuator (unit 75) corresponding to the distance $m_j$, the actuator is energized (unit 76). If otherwise, it is switched off (unit 77).

The signals for the control of the actuators are fed to the power amplifier 53 through the input/output 52.

After the operation with the cells is over, the temporary memory in the unit 78, 79 increases the magnitude of the counter of the supporting members and starts the input of the signal from the unit 8 of measuring current values of the grading characteristics.

From the power amplifier 53 the signals are fed to the actuators 9 positioned directly before the places of addressing and made in the form of electromagnets which control the position of the retainers 15. When the retainers are displaced, the tail piece 13 of the supporting member is released and acquires the position of stable equilibrium. This is the position when the conveyor portion is removed and the item is withdrawn directly to the place of addressing. The removal of the pivotable members takes place successively as they travel. The pivotable members assume their initial position by their interaction with the master forms 6.

The apparatus can employ for various embodiments of the conveyor, the supporting members of the conveyor can be arranged at an angle or horizontally, and the travel of the items can be effected by one or two conveyors. In the case of the transfer of the items by two conveyors, the supporting members are arranged at an angle, defining a U-shaped channel for accommodation of the items. When the number of the channels is increased so as to increase the apparatus throughput capacity, the supporting members of the adjacent U-shaped channels can be formed by the supporting members mounted on the same conveyor on the opposite sides with respect to the longitudinal axis of the conveyor. The retainers interacting with the supporting members are arranged lengthwise of the direction of the conveyor travel to ensure the possibility of successive interaction with one actuator.

INDUSTRIAL APPLICABILITY

The invention can be used in various branches of industry when grading items according to the grading characteristics preset by the user in the process of after-harvesting and pre-market treatment of agricultural products.

We claim:

1. A method of grading items comprising:

advancing a succession of items, one after the other in a single layer, on a conveyor, measuring a grading characteristic of each item as the item passes a measuring zone adjacent to the conveyor, comparing the grading characteristic of each item with a predetermined value;

transferring the items from the conveyor to addressing stations based on the compared grading characteristics of said items, said grading characteristic of each item being measured by measuring the orthogonal projection of each said item onto the conveyor, said conveyor being formed by successive transverse conveyor elements, each item having an orthogonal projection extending over at least three adjacent conveyor elements, said transferring of said items from the conveyor being effected by displacing said at least three conveyor elements.

2. A method as claimed in claim 1, wherein said at least three conveyor elements are displaced by pivotally moving said at least three conveyor elements.

3. A method as claimed in claim 2, comprising effecting said pivotal movement of said at least three conveyor elements about an axis extending substantially parallel to an axis of travel of said conveyor.

4. A method as claimed in claim 3, comprising forming said axis of travel of said conveyor as a rectilinear, longitudinal axis.

5. A method as claimed in claim 3, comprising forming said axis of travel of said conveyor as a circular axis.

6. A method as claimed in claim 1, comprising assigning the orthogonal projection of each item on the respective conveyor elements as the item passes said measuring zone, and effecting the transfer of the item from the conveyor by displacing, al together, the respective conveyor elements onto which the orthogonal projection of the item has been effected.

7. A method as claimed in claim 1, comprising arranging said transverse conveyor elements to form on said conveyor a U-shaped support surface for said items.

8. Apparatus for grading items comprising:

a conveyor, means for supplying a succession of items one after the other in a single layer on said conveyor, said conveyor having a direction of travel and including a plurality of successive transverse conveyor elements supported for pivotal movement about an axis extending in the direction of travel of the conveyor, means for measuring grading characteristics of said items as said items pass a measuring station during conveyance of the items on said conveyor, actuator means for pivotally moving said conveyor elements to displace the items from said conveyor when said items reach addressing stations corresponding to the measured grading characteristics of the respective items, said conveyor including means cooperating with said transverse conveyor elements to define a U-shaped channel for receiving said items therein, said means for measuring grading characteristics of said items including means for determining, for each item, the transverse conveyor elements onto which an orthogonal projection of said item falls, and means for controlling said actuator means to pivotally move, all together, the transverse conveyor elements onto which the orthogonal projection of the associated item has fallen to remove said associated item from the conveyor at the respective addressing station.

9. An apparatus as claimed in claim 8, wherein each conveyor element comprises an item-supporting portion and an integral tail piece pivotably mounted on the conveyor and a movable retainer retaining the tail piece in a pre-set position, said actuator means comprising an electromagnet fixed at the addressing stations for moving the retainer of the tail piece by an electromagnetic field without mechanical contact.

10. An apparatus as claimed in claim 8, wherein the direction of travel of the conveyor is along a straight line.

11. An apparatus as claimed in claim 8, wherein the direction of travel of the conveyor is along a closed loop.

12. An apparatus as claimed in claim 8, wherein said transverse conveyor elements form a portion of said U-shaped channel.

13. An apparatus as claimed in claim 12, comprising a second conveyor traveling beneath the first said conveyor, said conveyor elements being pivotably movable to release the items supported thereon for deposit by dropping onto the second conveyor.

14. An apparatus as claimed in claim 8, comprising a second conveyor adjacent to the first said conveyor, said second conveyor also including pivotable conveyor elements, the conveyor elements of both conveyors being inclined with respect to the vertical to form respective U-shaped channels for accommodation of the items therein and at least one conveyor being provided with similar conveying elements located on opposite sides with respect to a longitudinal axis of the conveyor.

15. An apparatus as claimed in claim 8, wherein said conveyor is in the form of a horizontal rotary loop including a restrictor arranged concentrically in said loop for rotating in synchronism with said conveyor and defining with the conveyor elements of the conveyor said U-shaped channel for accommodation of the items therein.

16. An apparatus as claimed in claim 15, wherein said restrictor is mounted for free rotation.

17. An apparatus as claimed in claim 15, comprising a plurality of metal sections providing equidistant spacing of the conveyor elements around the periphery of the conveyor.

18. Apparatus for grading items comprising:

a conveyor, means for supplying a succession of items one after the other in a single layer on said conveyor, said conveyor having a direction of travel and including a plurality of successive transverse conveyor elements supported for pivotal movement about an axis extending in the direction of travel of the conveyor, means for measuring grading characteristics of said items a said items pass a measuring station during conveyance of the items on said conveyor, actuator means for pivotally moving said conveyor elements to displace the items from said conveyor when said items reach addressing stations corresponding to the measured grading characteristics of the respective items, said conveyor including means cooperating with said transverse conveyor elements to define a U-shaped channel for receiving said items therein, said means for measuring grading characteristics of said items including means for determining, for each item, the transverse conveyor elements onto which an orthogonal projection of said item falls, means for controlling said actuator means to pivotally move, all together, the transverse conveyor elements onto which the orthogonal projection of the associated item has fallen to remove said associated item from the conveyor at the respective addressing station, each conveyor element including an item-supporting portion comprising a sleeve mounted for free rotation about an axis of said sleeve, and the sleeves of adjacent conveyor elements having oppositely directed threads thereon.

* * * * *